United States Patent [19]

Miles

[11] Patent Number: 5,032,309

[45] Date of Patent: Jul. 16, 1991

[54] FUNCTIONAL FLUIDS CONTAINING UREA HYDROLYTIC STABILIZERS

[75] Inventor: Peter Miles, Cheshire, England

[73] Assignee: Ciba-Geigy Corporation, Ardsley, N.Y.

[21] Appl. No.: 475,052

[22] Filed: Feb. 5, 1990

Related U.S. Application Data

[62] Division of Ser. No. 192,054, May 9, 1988, Pat. No. 4,919,833.

[30] Foreign Application Priority Data

May 21, 1987 [GB] United Kingdom ..... 8712091
Feb. 17, 1988 [GB] United Kingdom ..... 8803645

[51] Int. Cl.[5] ..... C10M 125/20

[52] U.S. Cl. ..... 252/77; 252/515 A; 252/515 R

[58] Field of Search ..... 252/77, 51.5 A, 51.5 R

[56] References Cited

U.S. PATENT DOCUMENTS

| | | | |
|---|---|---|---|
| 2,322,184 | 6/1943 | White | 564/36 |
| 2,911,368 | 11/1959 | Fowler et al. | 252/34 |
| 3,324,031 | 6/1967 | Motten | 252/42.1 |
| 3,655,560 | 4/1972 | Andress | 252/51.5 A |
| 3,706,657 | 12/1972 | Coran et al. | 252/51.5 A |
| 4,282,108 | 8/1981 | Deen et al. | 252/51.5 R |
| 4,369,118 | 1/1983 | Ryer et al. | 252/39 |
| 4,521,325 | 6/1985 | Sandel | 252/77 |
| 4,906,392 | 3/1990 | Adams | 252/47 |

*Primary Examiner*—Prince E. Willis
*Assistant Examiner*—J. Silbermann
*Attorney, Agent, or Firm*—JoAnn Villamizar

[57] ABSTRACT

A functional fluid comprising:

1) a base fluid selected from one or more of
   i) a phosphate fluid and
   ii) a carboxylic acid ester; and
b) as a hydrolytic stabilizer, at least one compound of the formula I $$A\text{-}NHC(=X)NHZ \quad (1)$$

wherein A is $C_3$–$C_{18}$alkenyl, $C_6$–$C_{10}$aryl or $C_7$–$C_{13}$alkaryl; X is oxygen; and Z is hydrogen.

8 Claims, No Drawings

FUNCTIONAL FLUIDS CONTAINING UREA HYDROLYTIC STABILIZERS

This is a divisional of application Ser. No. 192,054 filed on May 9, 1988 now U.S. Pat. No. 4,919,833.

The present invention relates to functional fluids e.g. hydraulic fluids and lubricants.

The use of flame-retardant phosphate fluids in various applications has increased rapidly in recent times. Firstly, they have proved useful as a safe alternative to the use of flammable mineral oil-based fluids and then, more recently, as a substitute for halogenated aromatic compounds which have met objections on environmental grounds.

These fluids are required to be hydrolytically stable over long periods in order that ingress of moisture will not cause deterioration of the fluid's performance. While the presence of moisture in the fluid may be combatted, to some extent, by the presence of additives such as rust inhibitors, co-additives such as antioxidants, metal passivators, and extreme pressure additives, they may generate, in the presence of moisture, acidic products which could catalyse the breakdown of the base fluid.

In the case of mineral oil-based fluids, epoxy compounds are conventionally included to combat the development of moisture-induced acidity. When epoxides are included for this purpose into phosphate-based formulations, however, their presence has been demonstrated to be detrimental.

Surprisingly, we have found that certain urea and semicarbazone derivatives impart effective hydrolytic stability to functional fluids susceptible to hydrolytic decomposition.

Accordingly, the present invention provides a functional fluid comprising:

a) a base fluid selected from one or more of i) a phosphate fluid and ii) a carboxylic acid ester; and b) as hydrolytic stabiliser, at least one compound having the formula I:

$$A\text{-}NHC(=X)NHZ \qquad (I),$$

in which A is hydrogen, $C_1$–$C_{12}$alkyl, $C_3$–$C_{18}$alkenyl, $C_6$–$C_{10}$aryl, $C_7$–$C_{13}$alkaryl, $C_7$–$C_{13}$aralkyl or $C_5$–$C_{12}$cycloalkyl; X is oxygen, sulphur or NH; and Z is H, $NH_2$ or $—N=CR_1R_2$ in which $R_1$ and $R_2$, independently, have any of the meanings assigned to A, or $R_2$ is H, or $R_1$ and $R_2$, together with the carbon atom to which they are each attached, may form a $C_5$–$C_{12}$ ring.

By the term "phosphate fluid" we mean any triaryl phosphate or mixed alkylphenyl/phenyl phosphate, preferably mixed isopropylphenyl/phenyl phosphate. Typical examples are those described e.g. in U.S. Pat. No. 3,576,023. Synthetic functional fluids and lubricants containing triaryl phosphates of various types are also described in U.S. Pat. Nos. 2,938,871, 3,012,057, 3,071,549, 3,468,802, 3,723,315 and 3,780,145. Specific examples of such phosphates are tricresyl phosphate (tritolyl phosphate), trixylyl phosphate, cresyldiphenyl phosphate, diphenyl ethylphenylphosphate, butyldiphenylphosphate, dicresylxylylphosphate, dibutylphenylphosphate, tributylphosphate, triamylphosphate, trioctyl phosphate and tri (isopropylated) phenyl phosphate; and mixed alkylphenyl/phenyl phosphates such as those prepared in the manner described in GB 1146173 by phosphorylating e.g. an isopropylphenol/phenol mixture which is obtained by alkylating phenol with 10–40% by weight of propylene; or mixed t-butylphenyl/phenyl phosphates such as those prepared by phosphorylating a t-butyl phenol/phenol mixture which is obtained by alkylating phenol with 10–30% by weight of iso-butylene.

Carboxylic acid ester base fluids may be di-, tri- or tetra-esters, complex esters or polyesters.

Diesters may be e.g. esters of formula:

$$R_3—OOC—alkylene—COO—R_4$$

wherein "alkylene" is a $C_2$–$C_{14}$alkylene residue and $R_3$ and $R_4$ are the same or different and each is a $C_1$–$C_{20}$alkyl group, and preferably a $C_6$–$C_{18}$-alkyl group.

Triesters which may be used as base fluids are those derived from trimethylolpropane and $C_6$–$C_{18}$monocarboxylic acids or mixtures thereof, whereas suitable tetraesters include e.g. those derived from pentaerythritol and a $C_6$–$C_{18}$monocarboxylic acid or mixtures thereof.

Complex esters suitable for use as base fluids are e.g. those derived from monobasic acids, dibasic acids and polyhydric alcohols, for instance the complex ester derived from trimethylolpropane, caprylic acid and sebacic acid.

Suitable polyesters are e.g. those derived from a $C_4$–$C_{14}$dicarboxylic acid and at least one aliphatic dihydric $C_3$–$C_{12}$alcohol, e.g. those derived from azelaic acid or sebacic acid and 2,2,4-trimethylhexane-1,6-diol.

Preferred carboxylic acid ester base fluids are diesters and pentaerythritol tetraesters. The mixture of a phosphate fluid and a dicarboxylic acid ester is also preferred. The base fluid may contain inert diluents e.g. mineral oils. When a group A in the compounds of formula I is an alkyl group it may be a methyl, ethyl, n-propyl, isopropyl, n-butyl, t-butyl, n-pentyl, n-hexyl, n-octyl, n-decyl or n-dodecyl group; alkenyl groups include allyl, methallyl, 1-octadecenyl and octadec-9-en-1-yl ("oleyl"); aryl or alkaryl groups include phenyl, tolyl, p-butylphenyl, naphthyl and methylnaphthyl; aralkyl groups A may be e.g. benzyl, 1-phenylethyl, 2-phenylethyl, $\alpha,\alpha$-dimethylbenzyl, or 2-phenylpropyl; $C_5$–$C_{12}$cycloalkyl groups A are e.g. cyclopentyl, cyclohexyl, cyclooctyl, cyclodecyl and cyclododecyl; or salts of compounds of formula I which salts are soluble in phosphate fluids, especially carboxylic acid salts e.g. acetate and oxalate salts.

When A is hydrogen and Z is hydrogen or $NH_2$, then examples of compounds of formula I include:

urea, urea oxalate, thiourea, semicarbazide, thiosemicarbazide, guanidine and guanidine acetate.

When A is $C_1$–$C_{12}$alkyl, $C_3$–$C_{18}$alkenyl, $C_6$–$C_{10}$aryl, $C_7$–$C_{13}$alkaryl, $C_7$–$C_{13}$-aralkyl or $C_5$–$C_{12}$cycloalkyl and Z is hydrogen or $NH_2$, examples of compounds of formula I include:

1,1-diethylurea, n-butylurea, isobutylurea, t-butylurea, t-amylurea, allylurea, oleylurea, 1-naphthylurea, phenylurea, 1-phenyl-3-thiourea, 4-phenyl-3-thiosemicarbazide and 4-phenylsemicarbazide.

When A is hydrogen and Z is a group $—N=CR_1R_2$, examples of such compounds of formula I include:

cyclohexanone semicarbazone, 2-octanone semicarbazone, cyclododecanone semicarbazone, cyclopentanone semicarbazone, hexanal semicarbazone and benzal semicarbazone.

Preferred compounds of formula I are those in which A is hydrogen, $C_3$–$C_{18}$alkenyl or $C_6$–$C_{10}$aryl and X is oxygen; and especially preferred are phenylurea, oleylurea and cyclohexanone semicarbazone.

The compounds of formula I are known materials and are readily obtainable by methods well known.

The compounds of formula I are effective as hydrolytic stabilisers in the compositions of the present invention in a preferred amount of 0.01–10% by weight, more preferably from 0.1 to 2.0% by weight, based on the total weight of the fluid.

The compounds of formula I may be used alone in the compositions of the invention but more usually are used together with one or more mutually compatible co-additives which are useful in improving the properties of functional fluids.

Thus, in order to improve various applicational properties, the compositions of the invention may also contain other additives (co-additives) such as one or more of demulsifying agents, anti-oxidants, metal deactivators, rust inhibitors, viscosity-index improvers, pour-point depressants, dispersants/surfactants, sulphur scavengers, anti-foamants or anti-wear additives.

Examples of such other additives are:

EXAMPLES OF DEMULSIFYING AGENTS

1. Fatty acid polyglycol esters e.g. the product commercially available as "EMULSOGEN® EL" from Hoechst AG; and 2. Polyethoxylated fatty acids e.g. the product "EMULSOGEN® EL-400" from Hoechst AG.

EXAMPLES OF PHENOLIC ANTIOXIDANTS

1. Alkylated Monophenols 2,6-Di-tert-butyl-4-methylphenol, 2,6-di-tert-butylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-i-butylphenol, 2,6-di-cyclcopentyl-4-methylphenol, 2-(β-methylcyclohexyl)-4,6-dimethylphenol, 2,6-di-octadecyl-4-methylphenol, 2,4,6-tricyclohexylphenol, 2,6-di-tert-butyl-4-methoxymethylphenol, o-tert-butylphenol.

2. Alkylated Hydroquinones 2,6-Di-tert-butyl-4-methoxyphenol, 2,5-di-tert-butylhydroquinone, 2,5-di-tert-amyl-hydroquinone, 2,6-diphenyl-4-octadecyloxyphenol.

3. Hydroxylated Thiodiphenylethers 2,2'-Thio-bis-(6-tert-butyl-4-methylphenol), 2,2'-thio-bis-(4-octylphenol), 4,4'-thio-bis-(6-tert-butyl-3-methylphenol), 4,4'-thio-bis-(6-tert-butyl-2-methylphenol).

4. Alkylidene-Bisphenols 2,2'-Methylene-bis-(6-tert-butyl-4-methylphenol), 2,2'-methylene-bis-(6-tert-butyl-4-ethylphenol), 2,2'-methylene-bis-(4-methyl-6-(α-methylcyclohexyl)-phenol), 2,2'-methylene-bis-(4-methyl-6-cyclohexylphenol), 2,2'-methylene-bis-(6-nonyl-4-methylphenol), 2,2'-methylene-bis-(4,6-di-tert-butylphenol), 2,2'-ethylidene-bis-(4,6-di-tert-butylphenol), 2,2'-ethylidene-bis-(6-tert-butyl-4- or -5-isobutylphenol), 2,2'-methylene-bis-(6-(α-methylbenzyl-4-nonylphenol), 2,2'-methylene-bis-(6-(α,α-dimethylbenzyl)-4-nonylphenol), 4,4'-methylene-bis-(2,6-di-tert-butylphenol), 4,4'-methylene-bis-(6-tert-butyl-2-methylphenol), 1,1-bis-(5-tert-butyl-4-hydroxy-2-methylphenol)-butane, 2,6-di-(3-tert-butyl-5-methyl-2-hydroxybenzyl)-4-methylphenol, 1,1,3-tris-(5-tert-butyl-4-hydroxy-2-methylphenyl)-3-n-dodecyl)-mercaptobutane, ethyleneglycol-bis-[3,3-bis-(3'-tert-butyl-4'-hydroxyphenyl)-butyrate], bis-(3-tert-butyl-4-hydroxy-5-methylphenyl)-dicyclopentadiene, bis-[2-(3'-tert-butyl-2'-hydroxy-5'-methyl-benzyl)-6-tert-butyl-4-methyl-phenyl]-terephthalate.

5. Benzyl Compounds 1,3,5-Tri-(3,5-di-tert-butyl-4-hydroxybenzyl)-2,4,6-trimethyl-benzene, bis-(3,5-di-tert-butyl-4-hydroxybenzyl)-sulfide, 3,5-di-tert-butyl-4-hydroxybenzyl-mercaptoacetic acid-isooctylester, bis-(4-tert-butyl-3-hydroxy-2,6-dimethylbenzyl)dithiolterephthalate, 1,3,5-tris-(3,5-di-tert-butyl-4-hydroxybenzyl)-isocyanurate, 1,3,5-tris-(4-tert-butyl-3-hydroxy-2,6-dimethylbenzyl)-isocyanurate, 3,5-di-tert-butyl-4-hydroxybenzyl-phosphonic acid-dioctadecylester, 3,5-di-tert-butyl-4-hydroxybenzyl-phosphonic acid-monoethylester, calcium-salt.

6. Acylaminophenols

4-Hydroxy-lauric acid anilide, 4-hydroxy-stearic acid anilide, 2,4-bis-octylmercapto-6-(3,5-di-tert-butyl-4-hydroxyanilino)-s-triazine, N-(3,5-di-tert-butyl-4-hydroxyphenyl)-carbamic acid octyl ester.

7. Esters of β-(3,5-Di-tert-butyl-4-hydroxyphenol)-propionic acid with mono- or polyhydric alcohols, for example with methanol, diethyleneglycol, octadecanol, triethyleneglycol, 1,6-hexanediol, pentaerythritol, neopentylglycol, tris-hydroxyethyl-isocyanurate, thiodiethyleneglycol, bis-hydroxyethyl-oxalic acid diamide.

8. Esters of β-(5-tert-butyl-4-hydroxy-3-methylphenyl)-propionic acid with mono- or polyhydric alcohols, for example with methanol, diethyleneglycol, octadecanol, triethyleneglycol, 1,6-hexanediol, pentaerythritol, neopentylglycol, tris-hydroxyethyl-isocyanurate, thiodiethyleneglycol, di-hydroxyethyl-oxalic acid diamide.

9. Amides of β-(3,5-Di-tert-butyl-4-hydroxyphenyl)-propionic acid for example N,N'-Bis-(3,5-di-tert-butyl-4-hydroxyphenylpropionyl)-hexamethylenediamine, N,N'-bis-(3,5-di-tert-butyl-4-hydroxyphenylpropionyl)-trimethylene-diamine, N,N'-bis-(3,5-di-tert-butyl-4-hydroxyphenylpropionyl)-hydrazine.

Examples of amine antioxidants

N,N'-Di-isopropyl-p-phenylenediamine, N,N'-di-sec.-butyl-p-phenylenediamine, N,N'-bis(1,4-dimethylpentyl)-p-phenylenediamine, N,N'-bis(1-ethyl-3-methyl-pentyl)-p-phenylenediamine, N,N'-bis(1-methyl-heptyl)-p-phenylenediamine, N,N'-dicyclohexyl-p-phenylenediamine, N,N'-diphenyl-p-phenylenediamine, N,N'-di-(naphthyl-2-)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluene-sulfonamido)-diphenylamine, N,N'-dimethyl-N,N'-di-sec-butyl-p-phenylenediamine, diphenylamine, N-allyldiphenylamine, 4-isopropoxy-diphenylamine, N-phenyl-1-naphthylamine, N-phenyl-2-naphthylamine, octylated diphenylamine, e.g. p,p'-di-tert-octyldiphenylamine, 4-n-butylaminophenol, 4-butyrylamino-phenol, 4-nonanoylamino-phenol, 4-dodecanoylamino-phenol, 4-octadecanoylamino-phenol, di-(4-methoxy-phenyl)-amine, 2,6-di-tert-butyl-4-dimethylaminomethyl-phenol, 2,4'-diamino-diphenylmethane, 4,4'-diamino-diphenylmethane, N,N,N',N'-tetramethyl-4,4'-diamino-diphenylmethane, 1,2-di-(phenylamino)-ethane, 1,2-di-[2-methyl-phenyl)-amino]-ethane, 1,3-di-(phenylamino)-propane, (o-tolyl)-biguanide, di-[4-(1',3'-dimethyl-butyl)-phenyl]amine, tert-octylated N-phenyl-1-naphthylamine, mixture of mono— and dialkylated tert-butyl-/tert-octyldiphenylamines, 2,3-dihydro-3,3-dimethyl-4H-1,4-benzothiazine, phenothiazine, n-allyl-phenothiazine.

Examples for other antioxidants

Aliphatic or aromatic phosphites, esters of thiodipropionic acid or of thiodiacetic acid, or salts of dithiocarbamic or dithiophosphoric acid.

Examples of metal deactivators, for example for copper, are:

Triazoles, benzotriazoles and derivatives thereof, tolutriazole and derivatives thereof, e.g. diethanolaminomethyl- and di(2-ethylhexyl)aminomethyl tolutriazole, 2-mercaptobenzothiazole, 2-mercaptobenzotriazole, 2,5-dimercaptothiadiazole, 2,5-dimercaptobenzotriazole, 5,5'-methylene-bis-benzotriazole, 4,5,6,7-tetrahydrobenzotriazole, salicylidene-propylenediamine and salicylaminoguanidine and salts thereof.

Examples of rust inhibitors are:

a) Organic acids, their esters, metal salts and anhydrides, e.g. N-oleoyl-sarcosine, sorbitan-mono-oleate, lead-naphthenate, alkenyl-succinic acids and —anhydrides, e.g. dodecenyl-succinic acid anhydride, succinic acid partial esters and amides, 4-nonyl-phenoxy-acetic acid.

b) Nitrogen-containing compounds, e.g. I. Primary, secondary or tertiary aliphatic or cycloaliphatic amines and amine-salts of organic and inorganic acids, e.g. oil-soluble alkylammonium carboxylates II. Heterocyclic compounds, e.g. substituted imidazolines and oxazolines.

c) Phosphorus-containing compounds, e.g. Amine salts of phosphonic acid or phosphoric acid partial esters, zinc dialkyldithio phosphates.

d) Sulfur-containing compounds, e.g. Barium-dinonylnaphthalene-n-sulfonates, calcium petroleum sulfonates.

Examples of viscosity-index improvers are:

Polyacrylates, polymethacrylates, vinylpyrrolidone/methacrylate-copolymers, polyvinylpyrrolidones, polybutenes, olefin-copolymers, styrene/acrylate-copolymers, polyethers.

Examples of pour-point depressants are:

Polymethacrylates, alkylated naphthalene derivatives.

Examples of dispersants/surfactants are:

Polybutenylsuccinic acid-amides or —imides, polybutenylphosphonic acid derivatives, basic magnesium—, calcium—, and bariumsulfonates and —phenolates.

Examples of anti-wear additives are:

Sulfur- and/or phosphorus- and/or halogen-containing compounds e.g. sulfurised vegetable oils, zinc dialkyldithiophosphates, tritolylphosphate, chlorinated paraffins, alkyl- and aryldi- and trisulfides and triphenylphosphorothionate.

The new functional fluids of the present invention have excellent hydrolytic stability. In particular, hydraulic fluids according to the present invention exhibit good hydrolytic stability when examined in the standard test method.

The following examples further illustrate the present invention. All parts and percentages given therein are by weight.

EXAMPLES 1 AND 2

The following functional fluid formulation is made up by weight:

100 parts of tri(isopropylated)phenyl phosphate
0.5 part of hindered phenol antioxidant
0.4 part of phenyl-α-naphthylamine antioxidant
1.0 part of a salt of a dialkylphosphorodithioic acid (extreme-pressure additive)
0.02 part of silicone antifoam and
0.1 part of hydrolysis stabiliser.

The formulation is then subjected to the following Brown Boveri Test Method No. ZLC 2-5-40 hydrolytic stability test. A sample of the fluid and water are stirred for 96 hours at 99° C. The liquids are then separated and each is titrated with alcoholic KOH. The extent of hydrolysis is reported in terms of the increase in the neutralisation number.

The results are shown in the following Table I:

TABLE I

| Example No. | Hydrolysis Stabiliser | Total Acidity Increase (mgKOH/g) |
|---|---|---|
| — | none (control) | 4.8 |
| 1 | phenylurea | 2.7 |
| 2 | 4-phenylsemicarbazide | 3.9 |

EXAMPLE 3

The following functional fluid composition was made up, by weight:

100 parts tri(isopropylated)phenyl phosphate
0.2 part hindered phenol antioxidant
0.01 part benzotriazole (metal passivator)
0.05 part (corrosion inhibitor)
1.0 part triphenylphosphorothionate (extreme pressure additive) and
0.1 part phenylurea (hydrolysis stabiliser).

The formulation was then subjected to the Brown Boveri Hydrolytic Stability Test and the results are shown in Table II:

TABLE II

| Example No. | Hydrolysis Stabiliser | Total Acidity Increase (mgKOH/g) |
|---|---|---|
| — | none (control) | 3.7 |
| 3 | phenylurea | 0.01 |

EXAMPLE 4

The following functional fluid composition was formulated by weight:

100 parts of tri(isopropylated)phenyl phosphate
0.5 part of hindered phenol antioxidant
0.4 part butyl hydroxy toluene antioxidant
0.4 part of phenyl-α-naphthylamine antioxidant
0.05 part oil-soluble benzotriazole (metal passivator)
1.0 part of a salt of a dialkylphosphorodithioic acid (extreme-pressure additive)
0.02 part of silicone antifoam and 0.5 part of cyclohexanone semicarbazone (hydrolysis stabiliser).

The results are summarized in Table III:

TABLE III

| Example No. | Hydrolysis Stabiliser | Total Acidity Increase (mgKOH/g) |
|---|---|---|
| — | none (control) | 4.8 |
| 4 | cyclohexanone semicarbazone | 2.3 |

EXAMPLES 5 TO 8

The following four carboxylic ester functional fluid compositions are formulated:

Example 5

100 parts by weight di(tridecyl) adipate and 0.1 part by weight oleylurea

Example 6

100 parts by weight di(tridecyl) adipate and 0.1 part by weight phenylurea

Example 7

100 parts by weight pentaerythritol tetra-ester derived from commercial mixed $C_5$–$C_7$- and $C_8$-acids some of which branched and others of which are of straight chain and 0.1 part by weight oleylurea;

Example 8

100 parts by weight pentaerythritol tetra-ester of Example 7 and 0.1 part by weight phenylurea.

Each composition is then subjected to an extended (8 days at 99° C. rather than 4 days at 99° C.) Brown Boveri Hydrolytic Stability Test.

The results obtained are set out in Table IV:

TABLE IV

| Example No. | Hydrolysis Stabiliser | Total Acidity Increase (mgKOH/g) |
|---|---|---|
| — | none (control) [base fluid: di(tridecyl)adipate] | 73.8 |
| 5 | oleylurea | 3.8 |
| 6 | phenylurea | 1.7 |
| — | none (control) [base fluid: pentaerythritol tetraester] | 10.03 |
| 7 | oleylurea | 0.8 |
| 8 | phenylurea | 1.05 |

EXAMPLES 9 AND 10

The following functional fluid composition is formulated and subjected to the Brown Boveri Hydrolytic Stability Test (4 days at 99° C.).

25 parts by weight di-2-ethylhexyl adipate 75 parts by weight tri(isopropylated)phenyl phosphate 0.2 part by weight hindered phenol antioxidant 0.01 part by weight oil soluble benzotriazole (metal passivator)

1 ppm silicone antifoam and 0.7 part by weight phenylurea.

The results are summarised in Table V:

TABLE V

| Example No. | Hydrolysis Stabiliser | Total Acidity Increase (mgKOH/g) |
|---|---|---|
| — | none (control) | >200 |
| 9 | phenylurea (0.7%) | 0.3 |
| 10 | phenylurea (1.0%) | 0.02 |

I claim:

1. A functional fluid comprising:

a) a base fluid selected from one or more of i) a phosphate fluid and ii) a carboxylic acid ester; and b) as a hydrolytic stabilizer, at least one compound of the formula I $$A\text{-}NHC(=X)NHZ \qquad (I)$$

wherein A is $C_3$–$C_{18}$alkenyl, $C_6$–$C_{10}$aryl or $C_7$–$C_{13}$alkaryl; X is oxygen; and Z is hydrogen.

2. A fluid according to claim 1 wherein the base fluid is a triaryl phosphate or a mixed alkylphenyl/phenyl phosphate.

3. A fluid according to claim 2 wherein the phosphate is a mixed isopropylphenyl/phenyl phosphate.

4. A fluid according to claim 1 wherein the base fluid is a carboxylic acid ester, which is a diester or a pentaerythritol tetraester.

5. A fluid according to claim 1 wherein the base fluid is a mixture of a phosphate fluid and a di-carboxylic acid ester.

6. A fluid according to claim 1 wherein the compound of formula I is oleylurea.

7. A fluid according to claim 1 wherein the amount present of the compound of formula I ranges from 0.01 to 10% by weight, based on the total weight of the fluid.

8. A fluid according to claim 1, wherein the compound of formula I is used together with one or more of a demulsifying agent, an antioxidant, metal deactivator, rust inhibitor, viscosity index improver, pour-point depressant, dispersant/surfactant, anti-foamant, sulphur scavenger or anti-wear additive as co-additives.

* * * * *